US008740332B2

(12) United States Patent
Okuyama

(10) Patent No.: US 8,740,332 B2
(45) Date of Patent: Jun. 3, 2014

(54) INKJET HEAD DRIVE METHOD AND INKJET HEAD DRIVE DEVICE

(75) Inventor: Kohei Okuyama, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 13/429,572

(22) Filed: Mar. 26, 2012

(65) Prior Publication Data

US 2012/0249637 A1 Oct. 4, 2012

(30) Foreign Application Priority Data

Mar. 29, 2011 (JP) ..... 2011-071841
Feb. 17, 2012 (JP) ..... 2012-032451

(51) Int. Cl.
*B41J 29/38* (2006.01)

(52) U.S. Cl.
USPC ..... 347/10

(58) Field of Classification Search
USPC ..... 347/9–11, 19, 40–43
IPC ..... B41J 29/38
See application file for complete search history.

(56) References Cited

U.S. PATENT DOCUMENTS 5,168,284 A 12/1992 Yeung
6,227,641 B1 5/2001 Nishikori et al.
6,270,180 B1 8/2001 Arakawa et al.
2004/0113960 A1* 6/2004 Usui ..... 347/10
2004/0223016 A1 11/2004 Koyama
2006/0152541 A1 7/2006 Isozaki et al.
2008/0174627 A1* 7/2008 Kamiyama ..... 347/17
2009/0167815 A1* 7/2009 Ito ..... 347/32
2009/0303274 A1* 12/2009 Iwata et al. ..... 347/17
2010/0194804 A1* 8/2010 Ozawa ..... 347/11

FOREIGN PATENT DOCUMENTS

JP 05-124195 A 5/1993
JP 08-295015 A 11/1996
JP 10-016228 A 1/1998
JP 11-138798 A 5/1999
JP 2001-080062 A 3/2001
JP 2004-262057 A 9/2004
JP 2006-199021 A 8/2006

* cited by examiner

*Primary Examiner* — Manish S Shah
*Assistant Examiner* — Roger W Pisha II
(74) *Attorney, Agent, or Firm* — Global IP Counselors, LLP

(57) ABSTRACT

An inkjet head driving method is a method for driving an inkjet head having a property in which heat is generated when a drive waveform is applied to a piezoelectric element section connected to a plurality of discharge nozzles. Based on drawing data, a discharge waveform, which is a drive waveform that causes discharging of ink, is applied to a driven nozzle for discharging the ink in a predetermined drive cycle, and a non-discharge waveform, which is a drive waveform that does not cause discharging of the ink, is applied to a non-driven nozzle other than the driven nozzle in the predetermined drive cycle.

9 Claims, 7 Drawing Sheets

INKJET HEAD DRIVE METHOD AND INKJET HEAD DRIVE DEVICE

CROSS-REFERENCE TO RELATED APPLICATIONS

This application claims priority to Japanese Patent Application No. 2011-071841 filed on Mar. 29, 2011 and Japanese Patent Application No. 2012-032451 filed on Feb. 17, 2012. The entire disclosures of Japanese Patent Application Nos. 2011-071841 and 2012-032451 are hereby incorporated herein by reference.

BACKGROUND

1. Technical Field

The present invention relates to a drive method and drive device for an inkjet head that selectively discharges ink from a plurality of discharge nozzles to perform recording based on image data.

2. Related Art

A known prior art drive device for an inkjet head is provided with a drive signal generating part that generates a drive waveform for discharging droplets from a plurality of nozzles, a data storage unit for storing rows of data specifying whether to enable discharging of each discharge nozzle, and a selector for selecting driven nozzles to which a discharge waveform is to be applied based on the rows of data (see Japanese Laid-Open Patent Application No. 2004-262057). The discharge nozzles have a nozzle drive section, and discharge droplets when the discharge waveform is applied to the nozzle drive section.

SUMMARY

In an inkjet head, heat is generated as the nozzle drive section is driven when a drive waveform is applied to the nozzle drive section of a discharge nozzle, and the temperature around the discharge nozzle increases. Therefore, there is a problem in that a temperature difference is produced between a driven discharge nozzle to which the drive waveform was applied and a non-driven discharge nozzle to which the drive waveform was not applied. Since the viscosity of the ink to be discharged varies in accordance with the temperature of the discharge nozzle, a difference is produced in the discharge amount due to the temperature difference and the drawing process cannot be carried out with good precision.

The temperature of the inkjet head increases in comparison with the start of the drawing process because heat that is generated with the driving of the nozzle drive section also builds up when the drawing process is continuous. The temperature of the ink inside the inkjet head also increases due to the variation in the temperature of the inkjet head, and the viscosity of the ink varies. A difference is produced in the discharge amount between the start of the drawing process and during a continuous drawing process, and a difference in density is generated and quality is not stable.

An object of the present invention is to provide a drive method and drive device for an inkjet head that can reduce to the extent possible the temperature difference between the driven nozzles and non-driven nozzles that are not included among the driven nozzles, and that can suppress temperature variations in the inkjet head during the drawing process.

An inkjet head driving method according to one aspect of the present invention is a method for driving an inkjet head having a plurality of discharge nozzles and a property in which heat is generated when a drive waveform is applied to a piezoelectric element section connected to each of the discharge nozzles. The inkjet head driving method includes: applying a discharge waveform, which is the drive waveform that causes discharging of ink, to at least one driven nozzle for discharging the ink in a predetermined drive cycle based on drawing data; and applying a non-discharge waveform, which is the drive waveform that does not cause discharging of the ink, to at least one non-driven nozzle other than the driven nozzle in the predetermined drive cycle based on the drawing data. The applying of the discharge waveform and the applying of the non-discharge waveform include applying the drive waveform to the piezoelectric element section so that a temperature in any location on a nozzle plate in which the discharge nozzles are formed is constant during a drawing process.

In the inkjet head driving method according to the above described aspect, the temperature of the inkjet head is preferably increased in advance at the start of discharging so that the temperature in any location of the nozzle plate is constant during the drawing process.

In the inkjet head driving method according to the above described aspect, a single drive cycle is preferably divided and the non-discharge waveform is preferably applied in a plurality of pulses so as to obtain the same amount of heat.

An inkjet head driving device according to another aspect of the present invention is a device for driving an inkjet head having a plurality of discharge nozzles and a property in which heat is generated when a drive waveform is applied to a piezoelectric element section connected to each of the discharge nozzles. The inkjet head driving device includes a drive waveform generating part and an application controlling part. The drive waveform generating part is configured to generate a discharge waveform, which is the drive waveform that causes discharging of ink, and a non-discharge waveform, which is the drive waveform that does not cause discharging of the ink. The application controlling part is configured to apply the discharge waveform and the non-discharge waveform to the piezoelectric element section in a predetermined drive cycle, the application controlling part being configured to apply the discharge waveform to at least one driven nozzle for discharging the ink in a predetermined drive cycle based on drawing data, and to apply the non-discharge waveform to at least one non-driven nozzle other than the driven nozzle in the predetermined drive cycle based on the drawing data. The drive waveform is applied to the piezoelectric element section so that a temperature in any location of a nozzle plate in which the discharge nozzles are formed is constant during a drawing process.

In accordance with these configurations, a non-discharge waveform is applied to the non-driven nozzles, which are discharge nozzles that are not included among the driven nozzles, based on drawing data, whereby the non-driven nozzles are heated in the same manner as the driven nozzles. For this reason, the temperature in any location of the nozzle plate in which a plurality of discharge nozzles is formed can be made constant during the drawing process based on any drawing data. Stated in other terms, the temperature of the ink inside the inkjet head can be made stable without much fluctuation during the drawing process. Consequently, the discharge amount and discharge speed of the ink of each discharge nozzle can be made stable during the drawing process.

In the inkjet head driving method according to the above described aspect of the present invention, the voltage at which the non-discharge waveform is applied is preferably 5% or more and 80% or less in relation to the voltage at which the discharge waveform is applied; and a number of applied pulses of the non-discharge waveform in a single drive cycle is preferably two or more.

When the voltage at which the non-discharge waveform is applied is less than 5%, the number of pulses required for the above-described amount of generated heat is dramatically increased because the amount of heat generated in a single pulse is inadequate. There are accordingly presented problems in that the number of pulses cannot be accommodated in a single drive cycle, and in that there is a greater possibility that a defect will occur in the piezoelectric element section, as well as other problems. On the other hand, when the voltage at which the non-discharge waveform is applied is greater than 80%, there is a risk that ink will be discharged.

In accordance with the configuration described above, the non-driven nozzles can be made to suitably generate heat because the non-discharge waveform is designed with optimal conditions with consideration given to the above-noted problems.

In the inkjet head driving method according to the above described aspect of the present invention, the discharge waveform and the non-discharge waveform are preferably applied with offset timing in a single drive cycle.

When the driving of the discharge waveform and the driving of the non-discharge waveform occur with identical timing, there is a problem in that the driving of the driven nozzles cannot be performed with good precision because the effect of driving the non-discharge waveform appears in the driving of the discharge waveform.

In contrast, the discharge waveform and the non-discharge waveform are applied with offset timing in accordance with the above-described configuration, the effect of driving a non-discharge waveform can be reduced and the driven nozzles can be driven with good precision. Since the discharge waveform and the non-discharge waveform can be generated in a continuous segment, the two discharge waveforms can be generated by a single drive waveform generation. It is possible to use a configuration in which the non-discharge waveform is applied with earlier timing than the discharge waveform, or a configuration in which the non-discharge waveform is applied with later timing than the discharge waveform.

In the inkjet head driving method according to the above described aspect of the present invention, the discharge waveform and the non-discharge waveform are preferably applied simultaneously in a single drive cycle.

In accordance with these configurations, the discharge waveform and the non-discharge waveform are applied with joint timing (simultaneously) in a single drive cycle, whereby the timing in which the driven nozzles and the non-driven nozzles generate heat is the same timing. Therefore, the driven nozzles and the non-driven nozzles can be placed in a more similar state, and more specifically, the temperature can be kept more uniform. Since the drive cycle can be reduced, it is possible to achieve higher density or to improve the number discharges per unit of time, and the drawing process can be carried out with greater precision.

In the inkjet head driving device according to the above described aspect of the present invention, the drive waveform generating part is preferably configured to generate a first discharge waveform that is applied to at least one driven nozzle for discharging an intermediate amount of ink, a second discharge waveform that is applied to at least one driven nozzle for discharging a small amount of ink, a first non-discharge waveform that corresponds to the first discharge waveform, and a second non-discharge waveform that corresponds to the second discharge waveform; and has a first drive waveform generation circuit for generating the first discharge waveform and the second non-discharge waveform in a continuous segment in each drive cycle, and a second drive waveform generation circuit for generating the first non-discharge waveform and the second discharge waveform in a continuous segment in each drive cycle. In a single drive cycle, the first discharge waveform and the first non-discharge waveform are preferably applied simultaneously, and the second discharge waveform and the second non-discharge waveform are preferably applied simultaneously.

In accordance with this configuration, the uniform state of the temperature in the plurality of discharge nozzles can be maintained even when the discharge amount changes, because the non-discharge waveform, which has a different heat output, is driven in conjunction with the driving of the discharge waveform, which has a different discharge amount. The discharge waveform and the non-discharge waveform are applied with joint timing, whereby the timing for generating heat can be made to be the same timing, the drive cycle can be shortened, higher density can be achieved or the number discharges per unit of time can be improved, and the drawing process can be carried out with greater precision. Furthermore, the drive waveform generating part can be provided with a simple configuration because it is possible to generate in a continuous segment the first discharge waveform and second non-discharge waveform, and the first non-discharge waveform and second discharge waveform. The drive waveform of a small discharge amount and the drive waveform of an intermediate discharge amount are applied to the piezoelectric element section of an arbitrary discharge nozzle in a single cycle, whereby a configuration for discharging a high discharge amount can be implemented. In other words, it is possible to control three levels of discharge amount.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
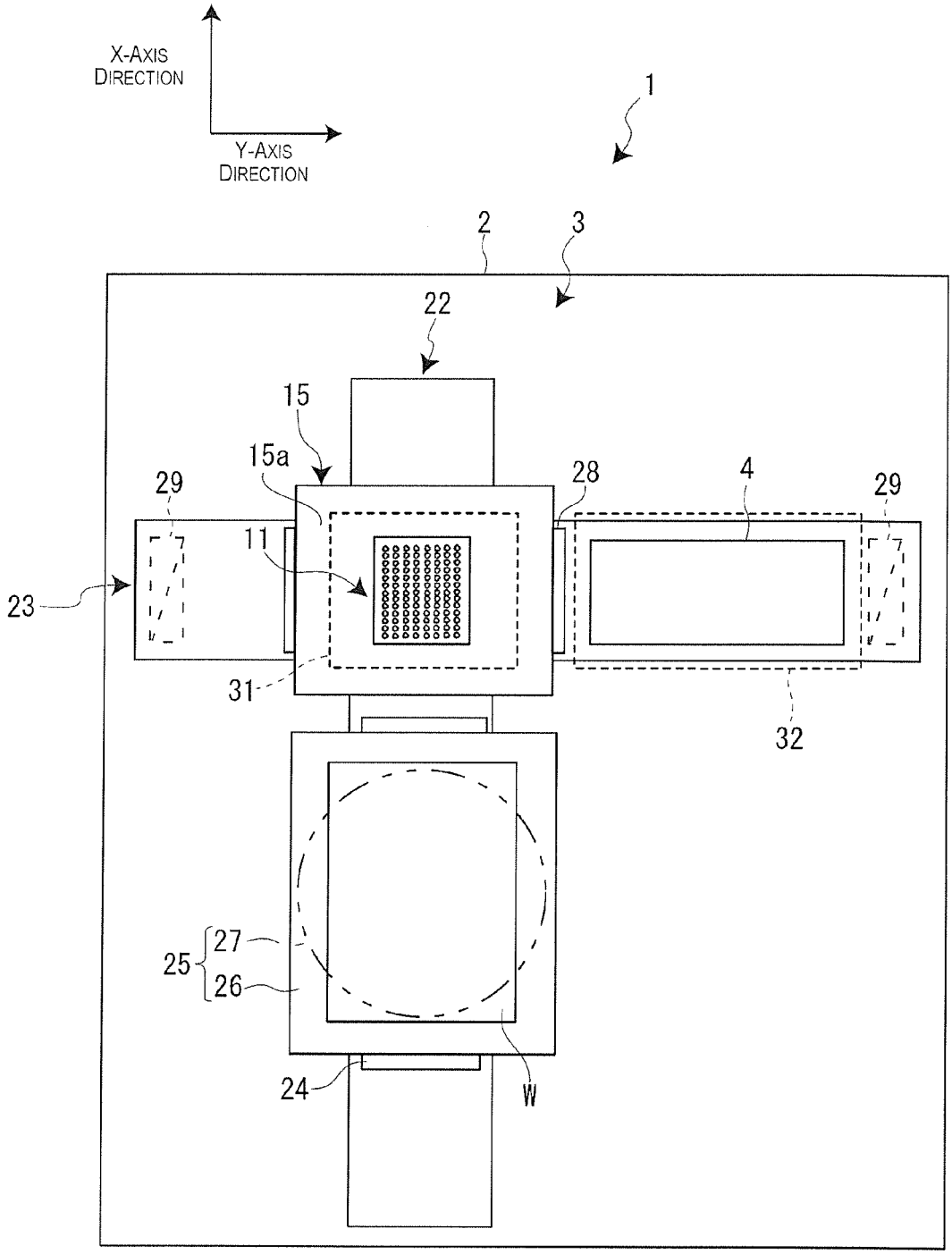
FIG. 1 is a schematic plan view showing the inkjet recording device according to the embodiments.

An inkjet recording device 1 to which the drive method for an inkjet head according to an embodiment of the present invention has been applied will be described with reference to the drawings. The inkjet recording device 1 is a device for selectively discharging ink from a plurality of discharge nozzles 46 with predetermined drive cycles to perform drawing (recording) based on image data. As shown in FIG. 1, the inkjet recording device 1 is provided with a machine base 2; a drawing device 3 in which an inkjet head 11 is mounted, the drawing device being placed widely over the entire area on the machine base 2; a maintenance device 4 disposed on the machine base 2 alongside the drawing device 3; and a control device (inkjet head drive device) 5 for controlling each part. The inkjet recording device 1 uses the maintenance device 4 to perform maintenance processing (function maintenance and restoration) of the inkjet head 11, and uses the drawing device 3 to perform drawing operations for discharging ink onto a workpiece W (recording medium). The present invention is particularly effective for ink in which the viscosity and volume vary due to temperature. Examples of such ink include UV ink that cures under UV rays; ink that contains dyes, pigments, functional material or the like in various solvents; and other inks.

The drawing device 3 has an X-axis table 22 arranged on the machine base 2 and mounted so as to allow the workpiece W to freely move in the X-axis direction, a Y-axis table 23 disposed over the X-axis table 22 so as to straddle the X-axis table via a pair of support columns 29 and so as to extend in the Y-axis direction orthogonal to the X-axis direction, and a carriage unit 15 suspended from the Y-axis table 23 so as to allow movement in the Y-axis direction. The carriage unit 15 is provided with a carriage plate 15*a*, and the inkjet head 11, which is mounted facing downward on a carriage plate 15*a*. Ink having high viscosity at normal temperature is introduced to the inkjet head 11 of the present embodiment.

The X-axis table 22 has an X-axis slider 24 driven by a motor constituting a drive system for the X-axis direction, and has a set table 25 composed of a chucking table 26 and a θ table 27 that is movably mounted on the X-axis slider. Similarly, the Y-axis table 23 has a Y-axis slider 28 driven by a motor constituting a drive system for the Y-axis direction, and has the carriage unit 15 movably mounted on the Y-axis slider. The Y-axis table 23 suitably moves the carriage unit 15 mounted thereon between a drawing area 31 positioned directly above the X-axis table 22 and a maintenance area 32 positioned directly above the maintenance device 4. The Y-axis table 23 causes the inkjet head 11 to face the workpiece W on the drawing area 31 and causes the inkjet head 11 to scan in the main scanning direction.

The inkjet recording device 1 configured in this manner performs maintenance processing on the inkjet head 11 as needed using the maintenance device 4 and performs drawing operations on the workpiece W using the drawing device 3. In other words, the drawing device 3 intermittently sends the workpiece W in the X-axis direction (secondary scanning) using the X-axis table 22 while under the control of the controller 5, causes the inkjet head 11 to reciprocate in synchrony therewith in the Y-axis direction (main scanning) using the Y-axis table 23, and drives the inkjet head 11 while selecting ink in predetermined drive cycles based on drawing data to perform drawing on the workpiece W.

Figure 2:
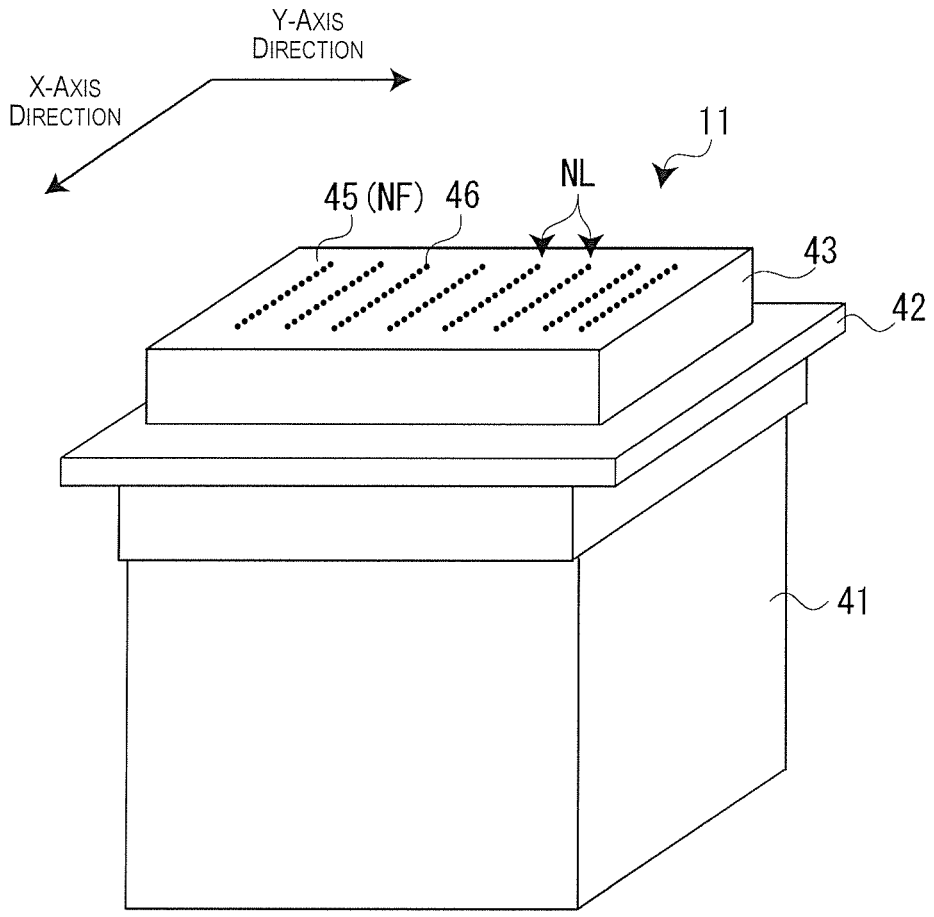
FIG. 2 is a perspective view showing an inkjet head.

The inkjet head 11 is provided with an ink-introducing section 41 having a plurality of connection needles, a head substrate 42 linked to the ink-introducing section 41, a pump section 43 linked to the head substrate 42, and a nozzle plate 45 linked to the pump section 43, as shown in FIG. 2. A plurality of nozzle rows NL is disposed in mutually parallel alignment on the nozzle face NF of the nozzle plate 45, and the nozzle rows NL are composed of 180 discharge nozzles 46 arranged with an equidistant pitch.

Figure 3:
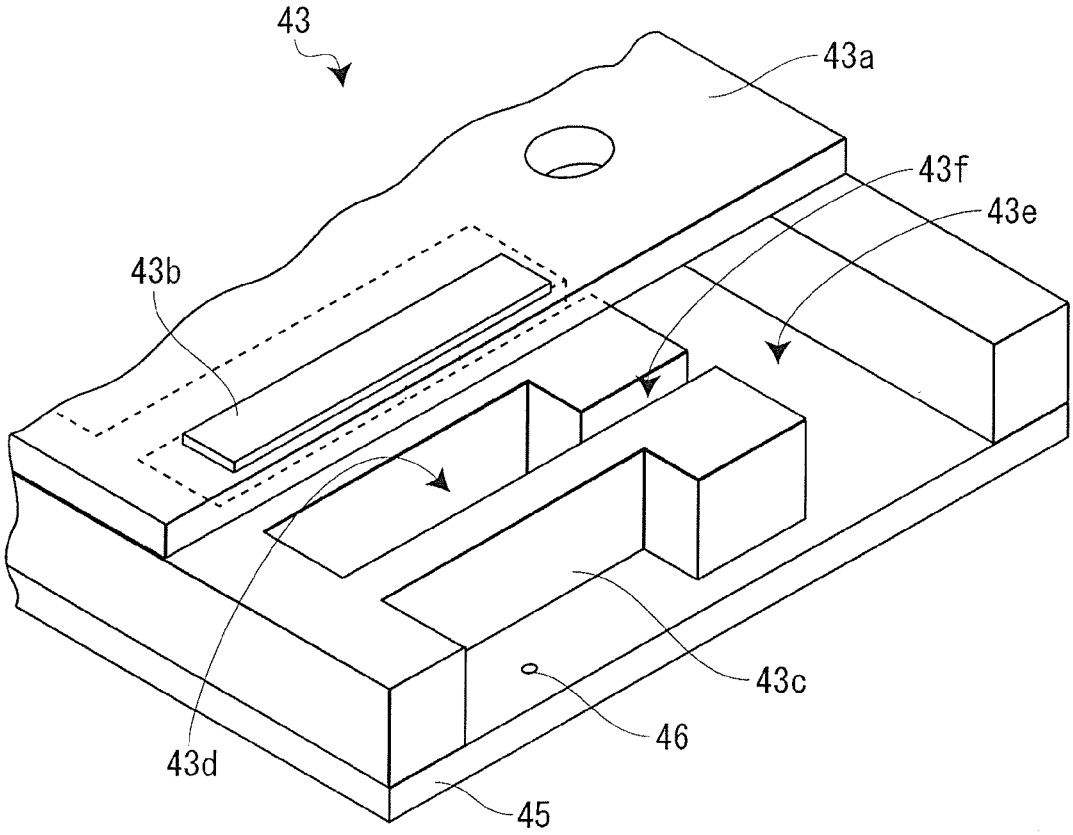
FIG. 3 is a schematic view showing the internal structure of an inkjet head.

The pump section 43 is composed of piezoelectric elements 43*b* (piezoelectric element section) that are disposed on an adhesive film 43*a*, that are linked to the discharge nozzles 46, and that cause ink to be discharged; and silicon cavities 43*c* that constitute pressure chambers 43*d* which correspond to the discharge nozzles 46, and that join the adhesive film 43*a* and the nozzle plate 45 together, as schematically shown in FIG. 3. Formed in the pump section 43 are a shared chamber 43*e* that holds ink to be fed to the pressure chambers 43*d* and that is in communication with the connection needles, and a feed channel 43*f* that connects the pressure chambers 43*d* and the shared chamber 43*e*. The pressure chambers 43*d* are in communication with the discharge nozzles 46 in corresponding fashion to the discharge nozzles 46 (piezoelectric elements 43*b*).

A flexible flat cable (not shown) linked to the controller 5 is connected to the head substrate 42, as shown in FIG. 2. A drive waveform (strictly speaking, a later-described discharge waveform) outputted from the controller 5 is applied to the pump sections 43 (the piezoelectric elements 43*b*), whereby ink is discharged from the discharge nozzles 46. The piezoelectric elements 43*b* have a property in which heat is generated when a drive waveform is applied. More specifically, as described later, the present inkjet recording device 1 is configured in response to this property so that a drive waveform is also applied to the piezoelectric elements 43*b* of the discharge nozzles 46 (non-drive waveform) that are not included among the driven nozzles that discharge ink, whereby the difference in the amount of heat between the driven nozzles and the non-driven nozzles is eliminated to the extent possible.

The temperature of the inkjet head 11 increases when the piezoelectric elements 43*b* generate heat with the application of a drive waveform. However, at the same time, the inkjet head 11 also has lost heat from heat conduction to members or the like that support the inkjet head 11, heat radiation to the surrounding environment, heat taken away by ink discharged by ink discharge, and other lost heat. When the drawing process continues, the temperature of the inkjet head 11 during continuation of the drawing process increases in comparison with the start of the drawing process, and the temperature gradient between the inkjet head 11 and the surroundings or the like increases in accordance with the increase in the temperature of the inkjet head 11, and the speed at which the heat migrates from the inkjet head 11 to the surroundings or the like also increases. Accordingly, the amount of heat loss per unit of time increases in contrast to the state in which the amount of heat generated per unit of time is constant, and the amount of generated heat and the amount of heat loss in the inkjet head 11 become substantially equal after reaching a certain temperature and thereafter. As a result, the temperature of the inkjet head 11 does not increase and becomes constant.

Figure 4:
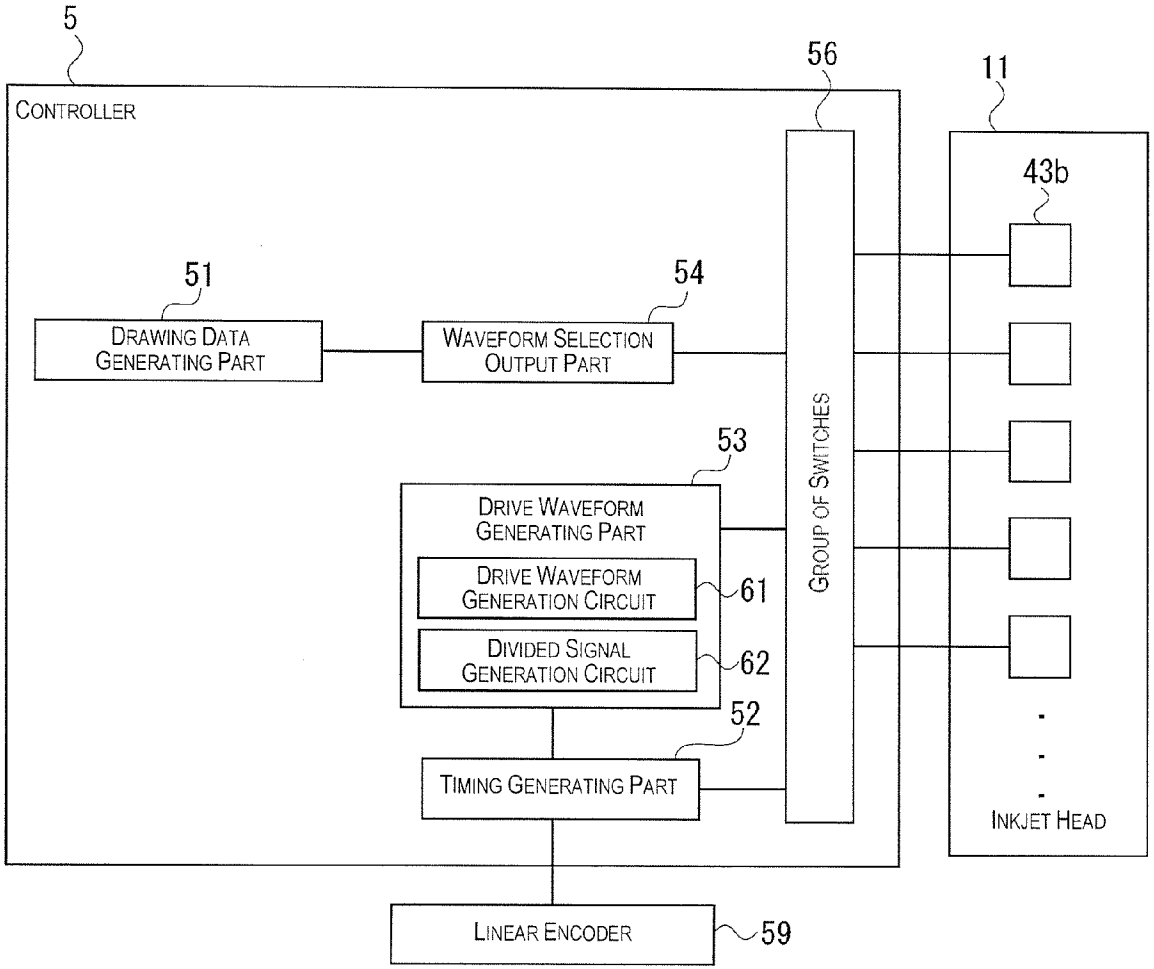
FIG. 4 is a control block view showing the control device of the first embodiment.

Next, the controller 5 will be described with reference to FIG. 4. The controller 5 has a drawing data generating part 51, a timing generating part 52, a drive waveform generating part 53, a waveform selection output part 54, and a group of switches 56. The term "application controlling part" stated in the claims is composed of the waveform selection output part 54 and the group of switches 56.

The drawing data generating part 51 stores drawing data specifying whether to enable discharging of the discharge nozzles 46 in each drive cycle during main scanning movement. Strictly speaking, the drawing data includes data specifying whether to enable discharging in each drive cycle in the main scanning movement for each of the 180 discharge nozzles 46. In other words, the data specifying whether to enable discharging is data that is arrayed in correspondence with each landing position, and is data in which the X axis is associated with the discharge nozzles 46 (nozzle numbers) and the Y axis is associated with the drive cycle. The drive cycle is a cycle in which outward movement or return movement of the main scanning movement is divided into a plurality of divisions, and which shows the drive timing of the discharge nozzles 46.

The timing generating part 52 receives an encoder signal (pulse signal) from a linear encoder 59 mounted on the Y-axis table 23 and outputs a latch signal. The intervals of the plurality of latch signals outputted by the timing generating part 52 are the drive cycles. For example, a single latch signal is outputted per predetermined number of pulses of the encoder signal. The number of pulses of the encoder signal corresponds to the movement distance (movement position) from the initial position of the carriage unit 15, and the latch signal can therefore be outputted in correspondence with the movement distance of the carriage unit 15.

Figure 5A:
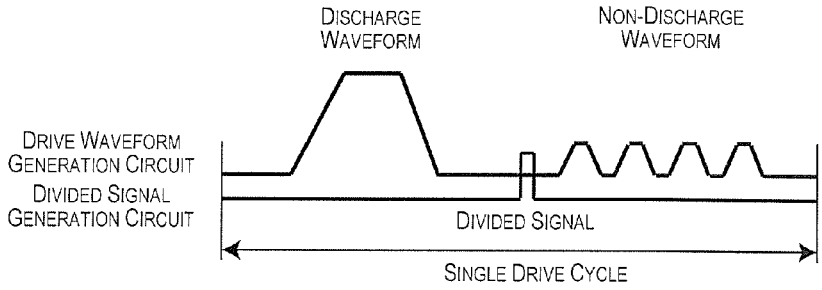
FIG. 5A is a view showing the drive waveform and divided signal of the first embodiment.

The drive waveform generating part 53 generates a drive waveform that is applied to the piezoelectric elements 43*b* of the discharge nozzles 46. Specifically, the drive waveform generating part 53 has a drive waveform generation circuit 61 for generating and outputting a drive waveform, and a divided signal generation circuit 62 for generating and outputting a divided signal obtained by dividing the drive cycle. Here, the drive waveform and the divided signal will be described in greater detail with reference to FIG. 5A. FIG. 5A is a view showing the drive waveform and divided signal in a single drive cycle. The drive waveform generation circuit 61 generates a discharge waveform, which is a drive waveform that is applied to the driven nozzles and that causes ink discharge, and a non-discharge waveform (heat-generating waveform), which is a drive waveform that is applied to the non-driven nozzles and that does not cause ink discharge, as shown in FIG. 5A; and the discharge waveform and the non-discharge waveform are generated in a continuous segment as drive waveforms of a single drive cycle unit. In other words, in a single drive cycle, the discharge waveform and the non-discharge waveform are generated with offset timing. Accordingly, the discharge waveform and the non-discharge waveform are applied to the piezoelectric elements 43*b* with offset timing. The divided signal generation circuit 62 divides a single drive cycle into two parts, and generates a divided signal with timing that divides the discharge waveform and the non-discharge waveform. The drive waveform generation circuit 61 receives a latch signal, generates the series of drive waveforms in each drive cycle, and outputs the drive waveforms to the piezoelectric elements 43*b*. On the other hand, the divided signal generation circuit 62 receives a latch signal, generates the divided signal for each drive cycle, and outputs the divided signal to the group of switches 56.

The discharge waveform is a drive waveform for discharging ink, and is composed of a trapezoid wave. On the other hand, the non-discharge waveform is a drive waveform for causing the piezoelectric elements 43*b* to generate heat without discharging ink, and is divided into and generated as a plurality of pulses in a single drive cycle. The non-discharge waveform is furthermore designed so that the amount of heat generated by the piezoelectric elements 43*b* due to application of a non-discharge waveform is the same amount of heat, minus the amount of heat taken away by the droplets discharged from the discharge nozzles 46, as the amount of heat generated by the piezoelectric elements 43*b* produced by application of a discharge waveform. In other words, a discharge waveform is applied to the piezoelectric elements 43*b* of all the discharge nozzles 46 of the inkjet head 11, the amount of generated heat (temperature increase) when ink is discharged is measured in advance, and the non-discharge waveform is designed so as to generate the measured amount of heat (temperature increase). Also, the non-discharge waveform application conditions are that the applied voltage of the non-discharge waveform is 5% or more and 80% or less in relation to the applied voltage of the discharge waveform; and that the number of applied pulses of the non-discharge waveform in a single drive cycle is two or more.

In addition to the heat generated by the piezoelectric elements 43*b*, the temperature of the inkjet head 11 is also affected by the heat generated by the circuit or the like for driving the piezoelectric elements. Accordingly, the amount of heat attributable to the inkjet head 11 is preferably adjusted to include the heat generated by circuits or the like.

The waveform selection output part 54 decodes drawing data in each drive cycle, extracts data specifying whether to enable discharging in drive cycle units, and outputs waveform position selection data to the group of switches 56 based on the data specifying whether to enable the discharge nozzles 46. The waveform position selection data is data that shows whether a leading-side or trailing-side drive waveform is to be applied to an arbitrary discharge nozzle 46 in a single drive cycle. The waveform selection output part 54 outputs information indicating that a leading-side drive waveform (discharge waveform) is to be applied to a discharge nozzle 46 in the case that the data specifying whether to enable an arbitrary discharge nozzle 46 is discharge-"enabled" (the case in which the discharge nozzles 46 are driven nozzles), and outputs information indicating that the trailing-side drive waveform (non-discharge waveform) is to be applied to the discharge nozzle 46 in the case that the data specifying whether to enable an arbitrary discharge nozzle 46 is discharge-"disabled" (the case in which the discharge nozzles 46 are non-driven nozzles).

The group of switches 56 switches on and off the transfer of drive waveforms to the piezoelectric elements 43*b* (the discharge nozzles 46) based on the waveform position selection data, the latch signal, and the divided signal. In other words, in the case that the waveform position selection data in any of the discharge nozzles 46 has information indicating that a leading-side drive waveform is to be applied, the latch signal is received, transfer to the discharge nozzle 46 is switched on, the divided signal is then received, and transfer to the discharge nozzle 46 is switched off. In other words, only the leading-side drive waveform (discharge waveform) is applied to the piezoelectric elements 43*b*. On the other hand, in the case that the waveform position selection data in any of the discharge nozzles 46 has information indicating that a trailing-side drive waveform is to be applied, the latch signal is received, transfer to the discharge nozzle 46 is switched off, the divided signal is then received, and transfer to the discharge nozzle 46 is switched on. In other words, only the trailing-side drive waveform is applied to the piezoelectric elements 43*b*.

In the drawing process, a drive waveform is outputted by the drive waveform generating part 53 in each drive cycle in accompaniment with main scanning, and the waveform position selection data in relation to the discharge nozzles 46 is outputted by the waveform selection output part 54 to the group of switches 56 based on the drawing data. Having thus received the waveform position selection data, the group of switches 56 selects a leading or trailing drive waveform based on the waveform position selection data, whereby a discharge waveform is applied to the driven nozzles and a non-discharge waveform is applied to the non-driven nozzles.

There are cases in which drawing data is based on various discharge patterns, and the ratio of discharge-"enabled" to discharge-"disabled" data specifying whether to enable the discharge nozzles 46 may fluctuate considerably in each drive cycle. In such a case, it is preferred that the discharge waveform or the non-discharge waveform be applied in each and all drive cycles in which at least discharging is possible. In an inordinate example, the non-discharge waveform is applied to all of the discharge nozzles 46 being used for discharge in the case that the data specifying whether to enable discharging in relation to all of the discharge nozzles 46 being used for discharge is discharge-"disabled." The amount of heat generated in each drive cycle thereby becomes constant even when discharges are made based on any drawing data, and the temperature of the inkjet head 11 can be held in a stable state in the drawing process.

The temperature of the inkjet head 11 at the start of the drawing process can be increased in advance to a temperature at which the amount of generated heat and the amount of lost heat are constant. Since the temperature of the inkjet head 11 during the drawing process can thereby be kept constant, quality is stabilized because the viscosity of the ink does not vary, the discharge amount is stable, and a difference in concentration does not occur between the start of the drawing process and midway through a continuous drawing process.

Figure 5B:
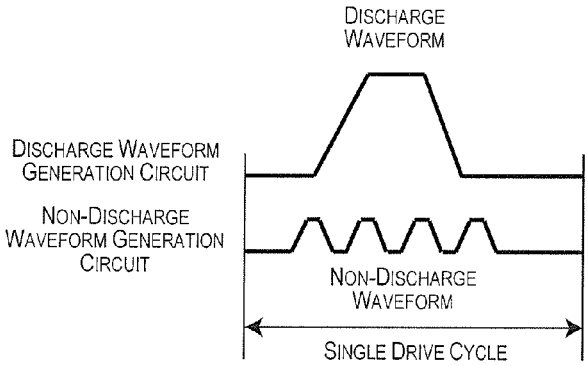
FIG. 5B is a view showing the drive waveform of the second embodiment.
Figure 6:
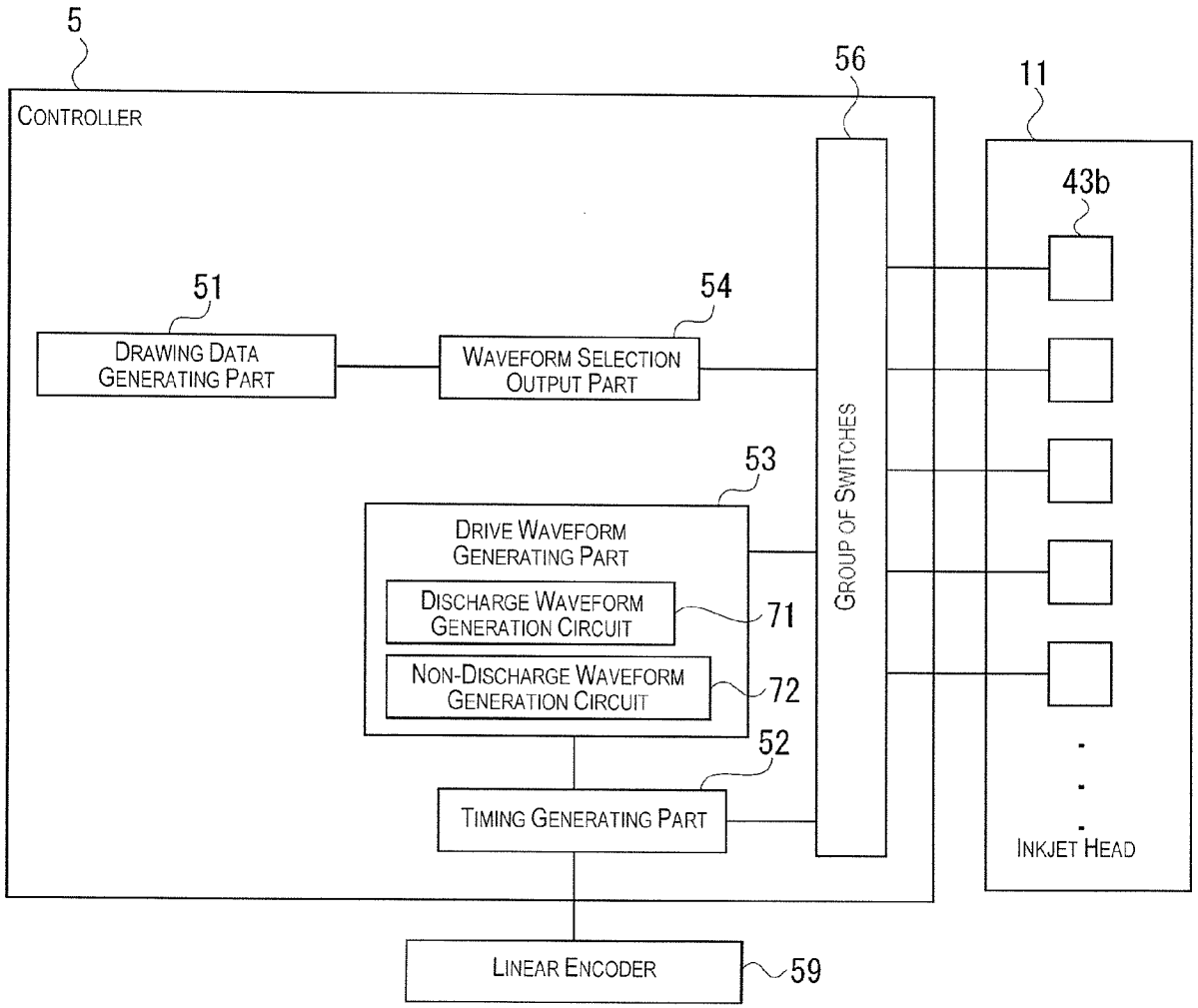
FIG. 6 is a control block view showing the control device of the second embodiment.

Next, the inkjet recording device 1 of a second embodiment will be described with reference to FIGS. 6 and 5B for only those portions that are particularly different. In the controller 5 of the inkjet recording device 1, the drive waveform generating part 53 has a discharge waveform generation circuit 71 for generating and outputting a discharge waveform, and a non-discharge waveform generation circuit 72 for generating and outputting a non-discharge waveform, as shown in FIG. 6. The discharge waveform and the non-discharge waveform are generated and applied with joint timing (simultaneously), as shown in FIG. 5B.

The waveform selection output part 54 outputs waveform selection data instead of waveform position selection data. The waveform selection data is data showing which drive waveform from the waveform generation circuits 71, 72 will be applied. In the case that the data specifying whether to enable an arbitrary discharge nozzle 46 is discharge-"enabled" (the case in which the discharge nozzle 46 is a driven nozzle), the waveform selection output part 54 outputs information indicating that the drive waveform (discharge waveform) of the discharge waveform generation circuit 71 will be applied to the discharge nozzle 46, and in the case that the data specifying whether to enable an arbitrary discharge nozzle 46 is discharge-"disabled", the waveform selection output part 54 outputs information indicating that the drive waveform (non-discharge waveform) of the non-discharge waveform generation circuit 72 will be applied to the discharge nozzle 46.

On the other hand, the group of switches 56 switches on and off the transfer of the drive waveform to the piezoelectric elements 43*b* (discharge nozzles 46) based on the waveform selection data and the latch signal. In other words, in the case that the waveform selection data for an arbitrary discharge nozzle 46 has information indicating that the drive waveform (discharge waveform) of the discharge waveform generation circuit 71 is to be applied, the latch signal is received, transfer of the drive waveform from the discharge waveform generation circuit 71 to the discharge nozzle 46 is switched on, and transfer of the drive waveform of the non-discharge waveform generation circuit 72 to the discharge nozzle 46 is switched off. In other words, the drive waveform (discharge waveform) from the discharge waveform generation circuit 71 is applied to the discharge nozzle 46. On the other hand, in the case that the waveform selection data for an arbitrary discharge nozzle 46 has information indicating that the drive waveform (non-discharge waveform) of the non-discharge waveform generation circuit 72 is to be applied, transfer of the drive waveform from the discharge waveform generation circuit 71 to the discharge nozzle 46 is switched off, and transfer of the drive waveform of the non-discharge waveform generation circuit 72 to the discharge nozzle 46 is switched on. In other words, the drive waveform (non-discharge waveform) from the non-discharge waveform generation circuit 72 is applied to the discharge nozzle 46. In this manner, the group of switches 56 selects the waveform generation circuit 71, 72 based on the waveform selection data, applies a discharge waveform to driven nozzles, and applies a non-discharge waveform to non-driven nozzles.

Figure 5C:
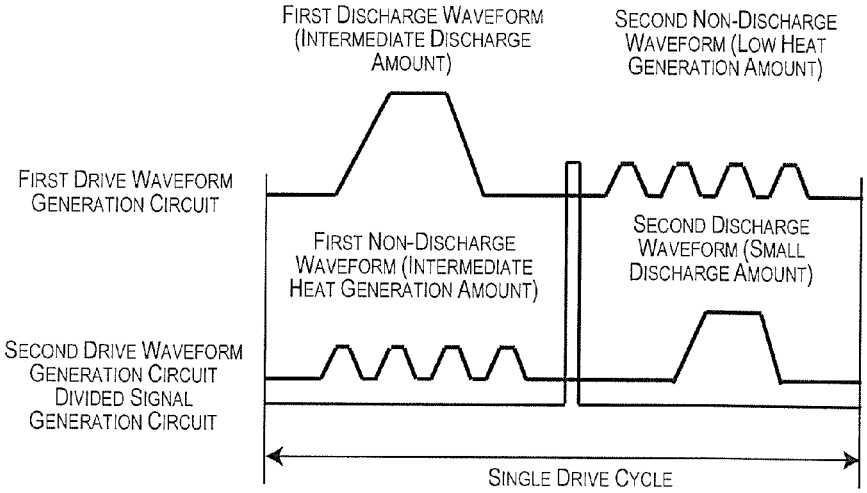
FIG. 5C is a view showing the drive waveform and divided signal of the third embodiment.
Figure 7:
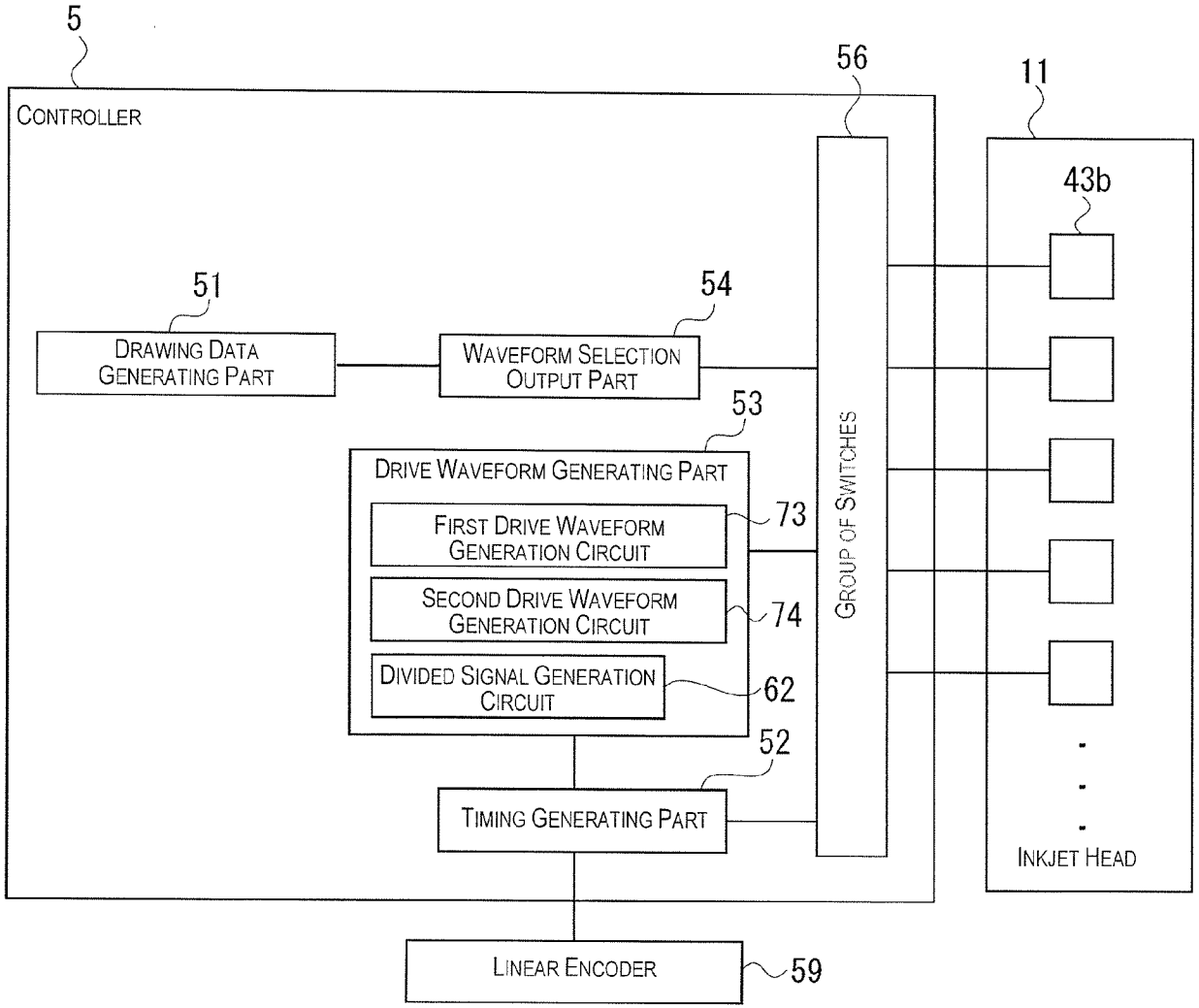
FIG. 7 is a control block view showing the control device of the third embodiment.

Next, the inkjet recording device 1 of a third embodiment will be described with reference to FIGS. 7 and 5C for only those portions that are particularly different. In the controller 5 of the inkjet recording device 1, the drawing data generating part 51 generates drawing data having endowed the drawing data with data that indicates the magnitude of the discharge amount and the magnitude of the heat amount to be generated, as shown in FIG. 7. Specifically, data that indicates the magnitude of the discharge amount (large discharge amount, intermediate discharge amount, or small discharge amount) is imparted to the data specifying whether to enable the discharge nozzles 46 in the case of discharge-"enabled" (the case in which the discharge nozzle is a driven nozzle), and data that indicates the magnitude of the discharge amount (high heat generation amount, intermediate heat generation amount, or low heat generation amount) is imparted in the case of discharge-"disabled" (the case in which the discharge nozzle is a non-driven nozzle).

On the other hand, the drive waveform generating part 53 has a first drive waveform generation circuit 73, a second drive waveform generation circuit 74, and the above-described divided signal generation circuit 62. The first drive waveform generation circuit 73 generates in a continuous segment in each drive cycle first discharge waveforms that are to be applied to driven nozzles for an intermediate discharge amount, and second discharge waveforms that are to be applied to non-driven nozzles for a low heat generation amount, as shown in FIG. 5C. The second drive waveform generation circuit 74 generates in a continuous segment in each drive cycle first non-discharge waveforms that are to be applied to driven nozzles for an intermediate heat generation amount, and second discharge waveforms that are to be applied to non-driven nozzles for a small discharge amount. The first discharge waveforms and first non-discharge waveforms in a single drive cycle are generated and applied with joint timing, and the second discharge waveforms and second non-discharge waveforms are generated and applied with joint timing.

The first discharge waveform is a drive waveform for discharging ink in an amount commensurate with the discharge amount set for an intermediate discharge amount. The second discharge waveform is a drive waveform for discharging ink in an amount commensurate with the discharge amount set for a small discharge amount. The first non-discharge waveform is a drive waveform for heating the piezoelectric elements 43*b* so to achieve that same amount of heat as the amount of heat generated by the piezoelectric elements 43*b* by the application of the first discharge waveform. The second non-discharge waveform is a drive waveform for heating the piezoelectric elements 43*b* so to achieve that same amount of heat as the amount of heat generated by the piezoelectric elements 43*b* by the application of the second discharge waveform.

The waveform selection output part 54 outputs the waveform position selection data and the waveform selection data based on the drawing data. On the other hand, the group of switches 56 switches on and off the transfer of the drive waveform to the piezoelectric elements 43*b* (discharge nozzles 46) based on the waveform position selection data, the waveform selection data, the latch signal, and the divided signal. The group of switches 56 thereby selectively applies the first discharge waveform, the second discharge waveform, the first non-discharge waveform, and the second non-discharge waveform to the piezoelectric elements 43*b*. Specifically, the second discharge waveform is applied to the driven nozzles for a small discharge amount, and the first discharge waveform is applied to the driven nozzles for an intermediate discharge amount. The first discharge waveform and the second discharge waveform are furthermore applied to the driven nozzles for a large discharge amount. On the other hand, the second non-discharge waveform is applied to the non-driven nozzles for a low heat generation amount, and the first non-discharge waveform is applied to the non-driven nozzles for an intermediate heat generation amount. The first non-discharge waveform and the second non-discharge waveform are furthermore applied to the non-driven nozzles for a large heat generation amount.

In accordance with the configuration of embodiments described above, a non-discharge waveform is applied to the non-driven nozzles based on the drawing data, whereby the temperature difference between the driven nozzles and the non-driven nozzles can be kept as low as possible. Stated in different terms, the heat generated by the driven nozzles and the heat generated by the non-driven nozzles can be made uniform. Consequently, it is possible to maintain a state in which the heat generated in a plurality of discharge nozzles 46 is uniform, and the ink discharge amount and discharge speed can be made uniform.

In the inkjet head 11, the temperature in the center part tends to be higher than the peripheral parts, and when the temperature of the nozzle face NF of the nozzle plate 45 is measured, the temperature of the center part tends to be higher than the peripheral parts of the nozzle face NF. The temperature of the ink in the center part can be said to be higher than the peripheral parts because the temperature of the nozzle plate 45 is relatively closer to the temperature of the ink inside the inkjet head 11. However, as long as the amount of generated heat attributable to the discharge nozzles 46 is constant, the temperature of the inkjet head 11 during a continuous drawing process is stable with a temperature difference, even when there is a temperature difference depending on the location. Therefore, the amount of ink discharged from the discharge nozzles 46 also has little fluctuation. For this reason, the temperature of the nozzle plate 45 is preferably kept constant the entire drawing process in the case that the temperature is measured in arbitrary locations.

The applied voltage of the non-discharge waveform is set to be 5% or more and 80% or less in relation to the applied voltage of the discharge waveform; and the number of applied pulses of the non-discharge waveform in a single drive cycle is set to be two or more, whereby the applied voltage and the applied number of pulses can be optimized, and the non-driven nozzles can be suitably heated.

In accordance with the first embodiment, the discharge waveform and the non-discharge waveform are applied with offset timing in accordance, whereby the effect of driving a non-discharge waveform can be reduced and the driven nozzles can be driven with good precision. Since the discharge waveform and the non-discharge waveform can be generated in a continuous segment, the two discharge waveforms can be generated by a single drive waveform generation circuit 61.

In accordance with the second embodiment, the discharge waveform and the non-discharge waveform are applied with joint timing, whereby the timing for generating heat with the driven nozzles and the non-driven nozzles becomes the same timing. Therefore, the driven nozzles and the non-driven nozzles can be placed in a more similar state, and the uniform state of the temperature can be more strictly maintained. Since the drive cycle can be shortened, higher density or a greater number of discharges per unit of time can be achieved, and the drawing process can be carried out with greater precision.

In accordance with the third embodiment, non-discharge waveforms for different heat generation amounts are driven in accordance with the driving of the discharge waveform for different discharge amounts. Therefore, the uniform state of the temperature in the plurality of discharge nozzles 46 can be maintained even if the discharge amount is varied. The discharge waveform and the non-discharge waveform are applied with joint timing, whereby the timing for generating heat can be made to be the same timing, and the drive cycle can be reduced. Therefore, higher density or a greater number of discharges per unit of time can be achieved, and the drawing process can be carried out with greater precision. Furthermore, the drive waveform generating part 53 can be configured in a simple manner because the first discharge waveform and the second non-discharge waveform, and the first non-discharge waveform and the second discharge waveform can be generated in a continuous segment.

In the present embodiment, the discharge waveform and the non-discharge waveform are configured as a trapezoid waveform, but no limitation is imposed thereby. For example, it is also possible to use a configuration in which only the discharge waveform is a trapezoid waveform and the non-discharge waveform is designed in a separate mode suitable for generating heat. No limitation is imposed by dividing the non-discharge waveform into a plurality of pulses in a single drive cycle, and it is also possible to use as configuration for generating and applying a non-discharge waveform that has a single pulse in a single drive cycle, as long as the non-discharge waveform is capable of generating heat in an amount that is equal to that of the discharge waveform.

In the third embodiment, a configuration was used in which two drive waveform generation circuits 73, 74 are provided and three levels of discharge amount are controlled, but it is also possible to use a configuration in which the number of drive waveform generation circuits 73, 74 is increased and a greater number of levels of discharge amount are controlled.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An inkjet head driving method for driving an inkjet head having a nozzle plate with a plurality of discharge nozzles and a property in which heat is generated during a plurality of drawing operations of a drawing process with the drawing operations being repeatedly performed with a predetermined drive cycle, with drive waveforms being applied to piezoelectric element sections connected to the discharge nozzles, respectively, based on drawing data in each of the drawing operations, the inkjet head driving method comprising:

applying a discharge waveform, which is a first one of the drive waveforms that causes discharging of ink, to at least one driven nozzle among the discharge nozzles that discharges the ink based on the drawing data in one of the drawing operations after commencing the drawing process; and applying a non-discharge waveform, which is a second one of the drive waveforms that does not cause discharging of the ink, to at least one non-driven nozzle among the discharge nozzles that does not discharge the ink based on the drawing data in the one of the drawing operations after commencing the drawing process, the at least one non-driven nozzle being different from the at least one driven nozzle, the applying of the discharge waveform and the applying of the non-discharge waveform including applying the drive waveforms to the piezoelectric element sections so that a temperature fluctuation along the discharge nozzles on the nozzle plate of the inkjet head is suppressed during the one of the drawing operations.

2. The inkjet head driving method according to claim 1, wherein the temperature of the inkjet head is increased in advance at a start of discharging so that the temperature in any location of the nozzle plate is constant during the drawing process.

3. The inkjet head driving method according to claim 1, wherein the drawing data includes various discharge patterns.

4. The inkjet head driving method according to claim 1, wherein the applying of the non-discharge waveform includes dividing a single drive cycle and applying a plurality of pulses so as to obtain the same amount of heat.

5. The inkjet head driving method according to claim 4, wherein a voltage at which the non-discharge waveform is applied is 5% or more and 80% or less in relation to a voltage at which the discharge waveform is applied, and a number of applied pulses of the non-discharge waveform in a single drive cycle is two or more.

6. The inkjet head driving method according to claim 1, wherein the discharge waveform and the non-discharge waveform are applied with offset timing in a single drive cycle.

7. An inkjet head driving method for driving an inkjet head having a plurality of discharge nozzles and a property in which heat is generated when a drive waveform is applied to a piezoelectric element section connected to each of the discharge nozzles, the inkjet head driving method comprising:

applying a discharge waveform, which is the drive waveform that causes discharging of ink, to at least one driven nozzle for discharging the ink in a predetermined drive cycle based on drawing data and applying a non-discharge waveform, which is the drive waveform that does not cause discharging of the ink, to at least one non-driven nozzle other than the driven nozzle in the predetermined drive cycle based on the drawing data, the applying of the discharge waveform and the applying of the non-discharge waveform including applying the drive waveform to the piezoelectric element section so that a temperature in any location on a nozzle plate in which the discharge nozzles are formed is constant during a drawing process, the discharge waveform and the non-discharge waveform being applied simultaneously in a single drive cycle.

8. An inkjet head driving device for driving an inkjet head having a nozzle plate with a plurality of discharge nozzles and a property in which heat is generated during a plurality of drawing operations of a drawing process with the drawing operations being repeatedly performed with a predetermined drive cycle, with drive waveforms being applied to piezoelectric element sections connected to the discharge nozzles, respectively, based on drawing data in each of the drawing operations, the inkjet head driving device comprising:

a drive waveform generating part configured to generate a discharge waveform, which is a first one of the drive waveforms that causes discharging of ink, and a non-discharge waveform, which is a second one of the drive waveforms that does not cause discharging of the ink; and an application controlling part configured to apply the discharge waveform and the non-discharge waveform to the piezoelectric element section in a predetermined drive cycle, the application controlling part being configured to apply the discharge waveform to at least one driven nozzle among the discharge nozzles that discharges the ink based on the drawing data in one of the drawing operations after commencing the drawing process, and to apply the non-discharge waveform to at least one non-driven nozzle among the discharge nozzles that does not discharge the ink based on the drawing data in the one of the drawing operations after commencing the drawing process, the at least one non-driven nozzle being different from the at least one driven nozzle, and the drive waveforms being applied to the piezoelectric element sections so that a temperature fluctuation along the discharge nozzles on the nozzle plate of the inkjet head is suppressed during the one of the drawing operations.

9. An inkjet head driving device for driving an inkjet head having a plurality of discharge nozzles and a property in which heat is generated when a drive waveform is applied to a piezoelectric element section connected to each of the discharge nozzles, the inkjet head driving device comprising:

a drive waveform generating part configured to generate a discharge waveform, which is the drive waveform that causes discharging of ink, and a non-discharge waveform, which is the drive waveform that does not cause discharging of the ink; and an application controlling part configured to apply the discharge waveform and the non-discharge waveform to the piezoelectric element section in a predetermined drive cycle, the application controlling part being configured to apply the discharge waveform to at least one driven nozzle for discharging the ink in a predetermined drive cycle based on drawing data, and to apply the non-discharge waveform to at least one non-driven nozzle other than the driven nozzle in the predetermined drive cycle based on the drawing data, and the drive waveform being applied to the piezoelectric element section so that a temperature in any location of a nozzle plate in which the discharge nozzles are formed is constant during a drawing process, the drive waveform generating part being configured to generate a first discharge waveform that is applied to at least one driven nozzle for discharging an intermediate amount of ink, a second discharge waveform that is applied to at least one driven nozzle for discharging a small amount of ink, a first non-discharge waveform that corresponds to the first discharge waveform, and a second non-discharge waveform that corresponds to the second discharge waveform; and the drive wave form generating part having a first drive waveform generation circuit for generating the first discharge waveform and the second non-discharge waveform in a continuous segment in each drive cycle, and a second drive waveform generation circuit for generating the first non-discharge waveform and the second discharge waveform in a continuous segment in each drive cycle, in a single drive cycle, the first discharge waveform and the first non-discharge waveform being applied simultaneously, and the second discharge waveform and the second non-discharge waveform are applied simultaneously.

* * * * *